US006673504B1

(12) United States Patent
Zimmer et al.

(10) Patent No.: US 6,673,504 B1
(45) Date of Patent: Jan. 6, 2004

(54) METHOD FOR APPLYING A COATING TO A SURFACE OF A MATERIAL

(76) Inventors: Michael Zimmer, Beerenfeldstrasse 11, DE-66133 Saarbrücken (DE); Horst Stedron, Am Gerichsköppel 6, D-35745 Herborn (DE); Waldemar Weinberg, Zum Eichwald 31, D-54444 Seibersbach (DE)

( * ) Notice: Subject to any disclaimer, the term of this patent is extended or adjusted under 35 U.S.C. 154(b) by 0 days.

(21) Appl. No.: 10/019,384

(22) PCT Filed: Jun. 15, 2000

(86) PCT No.: PCT/EP00/05482

§ 371 (c)(1),
(2), (4) Date: Apr. 26, 2002

(87) PCT Pub. No.: WO01/01201

PCT Pub. Date: Jan. 4, 2001

(30) Foreign Application Priority Data

Jun. 28, 1999 (DE) ..... 199 29 522

(51) Int. Cl.[7] ..... G03G 13/14
(52) U.S. Cl. ..... 430/126; 430/105; 430/124
(58) Field of Search ..... 430/126, 105, 430/124

(56) References Cited

U.S. PATENT DOCUMENTS 5,905,012 A * 5/1999 De Meutter et al. ..... 430/124
6,461,782 B1 * 10/2002 Sasada et al. ..... 430/109.2

FOREIGN PATENT DOCUMENTS

EP 647 885 7/1999
WO WO 99/46645 * 9/1999

* cited by examiner

*Primary Examiner*—Mark A. Chapman
(74) *Attorney, Agent, or Firm*—Pauley Petersen & Erickson

(57) ABSTRACT

A method for applying a coating to a surface of a material while using electrophotography. According to this invention, a supporting material provided with a photoconductive layer has an electrostatic charge pattern, a coating material is applied to the supporting material with the aid of electrostatic forces, and the coating material is applied to the subject to be coated. In order to produce high-quality surface coatings, according to this invention, at least the duromer constituents including a resin and a hardener are applied, together or in succession, as a coating material to the supporting material.

15 Claims, 1 Drawing Sheet

METHOD FOR APPLYING A COATING TO A SURFACE OF A MATERIAL

BACKGROUND OF THE INVENTION

1. Field of the Invention

This invention relates to a method for applying a coating to a surface of a workpiece, using electro-photography, wherein a support with a photoconductive layer is provided with an electrostatic charge image, wherein a coating material is applied to the carrier by using electrostatic force, and wherein the coating material is applied to the workpiece to be coated.

2. Description of Related Art

A method known from European Patent Reference EP 0 647 885 A1 is used for imprinting ceramic and glass products. A toner is used as the coating material, and the toner particles have a pigment core. The pigment core is made of ceramic pigments and is surrounded by a binder resin shell. Charge control agents are connected to the binder resin shell. With an electrostatic copying process the toner is applied on a paper coated with gum arabic. A clear lacquer is applied to the coated paper for fixing. Thereafter, the paper can be placed on the ceramic or glass product to be coated and can be wetted. The paper can then be pulled off, while the gum arabic layer and the colored coating applied to the gum arabic layer adhere to the ceramic or glass product. This is finally followed by a firing process, wherein the color pigments melt together with the surface of the ceramic or glass product. With this process it is possible to apply high-quality, particularly scratch-resistant coatings to a workpiece. However, only such workpieces can be coated which can withstand the firing process without damage.

Coating materials are also known, which have a thermoplastic material as the basic material, which melts at low temperatures. The thermoplastic material is mixed with color pigment and charge control agents. This coating material is applied by an electrostatic printing process to a paper to be coated. The coated paper is finally fixed at a temperature approximately between 90° C. and 170° C. A coating thus produced is sensitive to mechanical effects.

SUMMARY OF THE INVENTION

It is one object of this invention to provide a method of the type mentioned above but wherein qualitatively high-grade surfaces can be produced.

This object is achieved with at least the duromer components resin and hardener applied as the coating material to the carrier together or one after the other. With this process, duromer coatings can be applied to workpieces in a simple manner. These coatings have a high surface quality and in particular are scratch-resistant and temperature-proof.

In accordance with one embodiment of this invention, the hardener is stored together with the resin in a storage container in the form of material particles, the material particles are doped with charge carriers, and the material particles, together with the charge carriers, are electrostatically applied to the carrier.

Alternatively, the hardener and the resin are stored separately from each other in the form of hardener or resin particles in storage containers, the resin and the hardener particles are doped with charge carriers, and the material particles are electrostatically applied to the carrier by the charge carriers.

With the method of this invention, it is possible to attribute defined properties to the coating. This is possible if fillers and/or coloring agents and/or additives are mixed with the coating material. The fact that the coating material can be used as a "vehicle" for defined materials is useful. Accordingly, the vehicles convey the materials to the workpiece and fix them on the surface of the workpiece.

To fix the applied coating material, it can polymerize under the reaction of temperature and/or pressure.

In one embodiment of this invention, the coating material is applied to a planar intermediate carrier having an adhesive layer, the intermediate carrier is placed with its coated side on the workpiece and following the placement of the intermediate carrier on the workpiece, the adhesiveness of the coating material is cancelled and then the intermediate carrier is lifted off the workpiece.

Thus it is initially possible to produce patterns, similar to decals, which can be applied at a later time to the workpiece to be coated. For example, this has advantages if there is a difference in the locality of the actual workpiece production and the electro-photographic coating generation.

Gum arabic, wax or silicon can for example be applied to the intermediate carrier as the adhesive layer. Thus it is possible to cancel the adhesion between the intermediate carrier and the coating material using water with the gum arabic, and by the application of heat with wax. Different materials can be employed as intermediate carriers. For example, an intermediate carrier made of paper or cardboard can be used.

To prevent the possibility of damage to the coating material by mechanical effects when an intermediate carrier is transported, a protective layer, for example a lacquer layer, can be applied over the coating material.

BRIEF DESCRIPTION OF THE DRAWINGS

This invention is explained in greater detail in view of exemplary embodiments represented in the drawings, wherein.

DESCRIPTION OF PREFERRED EMBODIMENTS

Figure 1:
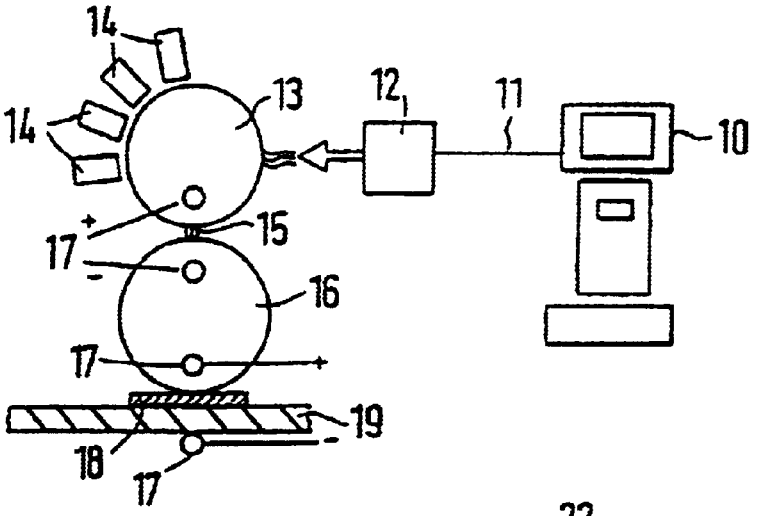
FIG. 1 is a schematic representation of an electro-photographic coating device.

A coating device is schematically represented in FIG. 1. The coating device has a personal computer 10, which is connected with an illuminating arrangement 12 via a data line 11. The illuminating arrangement 12 has a laser or a laser diode chain, a so-called "laser comb", LED "comb", which operates together with a carrier 13. The carrier 13 is designed as an image roller, which has a photoconductive layer. A plurality of storage containers 14 are assigned to the carrier 13. The duromer component resin is housed in one of the storage containers 14, the duromer component hardener in a further storage container. Additives, fillers or coloring agents can be housed in the further storage containers. It is also possible to use only a single storage container, in which the components resin 21 and hardener 22, as well as possible filler and coloring agents are housed. It is also possible to employ four storage containers 14, in each of which the duromer components resin 21 and hardener 22, as well as different coloring agents and possibly additives or fillers are stored. In this case, cyan-dyed, magenta-dyed, yellow-dyed or black-dyed coloring agents are housed in the various storage containers as the coloring agents. A roller-shaped intermediate carrier 16 adjoins the carrier 13. A contact zone 15 is formed between the intermediate carrier 16 and the carrier 13. A corona 17 is housed in the area of the contact zone 15.

The intermediate carrier 16 rolls off on a workpiece 18, which rests on a transport means 19. A further corona 17 is arranged in the area between the transport means 19 and the intermediate carrier 16.

For the coating process, first a coating pattern generated by the personal computer 10, for example a colored image, is transmitted via the data line 11 to the illuminating arrangement 12. From there, a latent electrostatic charge image is transferred by the laser to the carrier 13. The charge image causes the materials stored in the storage containers 14, in particular the resin 21 and the hardener 22, to be deposited on the charged locations of the carrier 13. The corona 17 arranged in the area of the contact zone 15 causes the coating material located on the carrier 13 to be transferred to the intermediate carrier 16. The second corona 17 repels the coating material from the intermediate carrier 16, so that it can reach the surface of the workpiece 18.

In this way the coating pattern is transferred to the workpiece 18 in the form it was generated in the personal computer 10. Following the successful coating 23, the resin 21 and the hardener 22 can be polymerized out by temperature and/or pressure action, so that a hard coating with good surface properties is created on the workpiece 18.

Figure 2A:
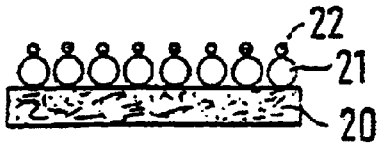
FIGS. 2*a* to 2*f* schematically show coating methods in different method stages.

Alternative embodiment variations of the above described method are represented in FIGS. 2*a* to 2*f*. In these alternative embodiment, a further intermediate carrier 20 is respectively imprinted following the intermediate carrier 16. The further intermediate carrier 20 has a planar material blank, for example a paper or cardboard blank. As FIG. 2*a* shows, the resin 21 can be applied together with the hardener 22 in one coating process. This becomes possible, for example, if resin 21 and hardener 22 are both present in one storage container 14.

Figure 2B:
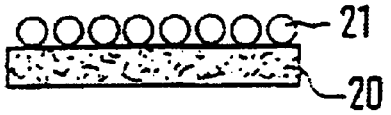
Figure 2C:
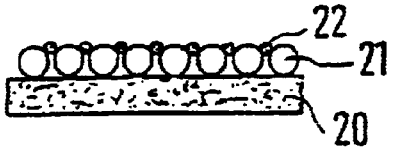

However, it is also possible that, as symbolized by FIG. 2*b*, first a coating process occurs, in which the resin 21 is applied to the intermediate carrier 20. Thereafter (FIG. 2*c*), the hardener 22 is layered over the resin 21 in a further coating process. It is also possible that first the hardener 22 and then the resin 21 are applied to the intermediate carrier 20. The intermediate carrier 20 is coated with an adhesive layer, for example of gum arabic or wax. The coating material is held on the adhesive layer.

Figure 2D:
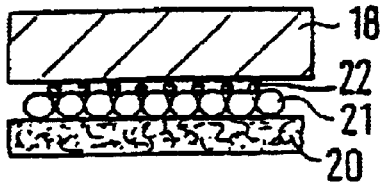
Figure 2E:
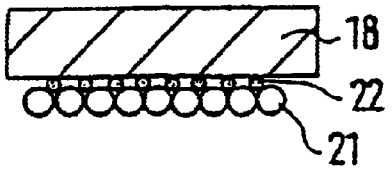
Figure 2F:
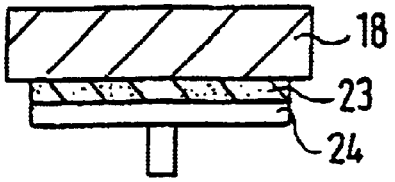

As shown in FIG. 2*d*, the intermediate carrier can be placed on a workpiece 18. Subsequently, the adhesive force between the coating material and the intermediate carrier 20, exerted by the adhesive layer, is cancelled. The intermediate carrier 20 can then be removed, while the coating material adheres to the workpiece 18. This process step is illustrated in FIG. 2*e*. A die 24 is pressed on the coating material for final fixation. During this, heat is simultaneously introduced into the coating material. The duromer is polymerized by this action of temperature and pressure. It is also possible that a roller is used instead of the die 24, which also introduces pressure and heat into the coating material.

What is claimed is:

1. In a method for applying a coating to a surface of a workpiece, using electro-photography, wherein a support having a photoconductive layer is provided with an electrostatic charge image, wherein a coating material is applied to the carrier by electrostatic force, and wherein the coating material is applied to the workpiece to be coated, and at least duromer components resin (21) and a hardener (22) are applied together to the carrier (13), the improvement comprising:

the hardener (22) stored together with the resin (21) in a storage container in a form of material particles, the material particles doped with charge carriers, and the material particles together with the charge carriers electrostatically applied to the carrier (13).

2. In the method in accordance with claim 1, wherein at least one of fillers, coloring agents and additives are mixed with the coating material.

3. In the method in accordance with claim 2, wherein the coating material applied to the workpiece is made to polymerize by an action of at least one of temperature and pressure.

4. In the method in accordance with 3, wherein the coating material on the carrier (16) is applied to at least one intermediate carrier (16, 20), and the coating material is applied from the at least one intermediate carrier (16, 20) to the workpiece to be coated.

5. In the method in accordance with 4, wherein the coating material is applied to a planar intermediate carrier (20) having an adhesive layer, the intermediate carrier (20) is placed with a coated side on the workpiece (19), after placement of the intermediate carrier (20) on the workpiece (19) the adhesiveness of the coating material is cancelled and then the intermediate carrier (20) is lifted off the workpiece (19).

6. In the method in accordance with claim 5, wherein one of a gum arabic, a wax and a silicon is applied to the intermediate carrier (20) as the adhesive layer.

7. In the method in accordance with claim 5, wherein the coating material is applied to an intermediate carrier (20) which is made from one of a paper and a cardboard.

8. In the method in accordance with claim 5, wherein a protective layer is placed on the coating material applied to the intermediate carrier.

9. In the method in accordance with claim 6, wherein the coating material is applied to an intermediate carrier (20) which is made from one of a paper and a cardboard.

10. In the method in accordance with claim 7, wherein a protective layer is placed on the coating material applied to the intermediate carrier.

11. In the method in accordance with claim 10, wherein the protective layer is a lacquer coating.

12. In the method in accordance with claim 1, wherein the coating material applied to the workpiece is made to polymerize by an action of at least one of temperature and pressure.

13. In the method in accordance with 1, wherein the coating material on the carrier (16) is applied to at least one intermediate carrier (16, 20), and the coating material is applied from the at least one intermediate carrier (16, 20) to the workpiece to be coated.

14. In the method in accordance with 1, wherein the coating material is applied to a planar intermediate carrier (20) having an adhesive layer, the intermediate carrier (20) is placed with a coated side on the workpiece (19), after placement of the intermediate carrier (20) on the workpiece (19) the adhesiveness of the coating material is cancelled and then the intermediate carrier (20) is lifted off the workpiece (19).

15. In the method in accordance with claim 14, wherein one of a gum arabic, a wax and a silicon is applied to the intermediate carrier (20) as the adhesive layer.

* * * * *

UNITED STATES PATENT AND TRADEMARK OFFICE

CERTIFICATE OF CORRECTION

PATENT NO. : 6,673,504 B1
DATED : January 6, 2004
INVENTOR(S) : Michael Zimmer et al.

It is certified that error appears in the above-identified patent and that said Letters Patent is hereby corrected as shown below:

Column 3,
Line 60, replace "support" with -- carrier --

Signed and Sealed this

Thirteenth Day of July, 2004

JON W. DUDAS
*Acting Director of the United States Patent and Trademark Office*